United States Patent [19]

Hardin

[11] Patent Number: 4,589,337

[45] Date of Patent: May 20, 1986

[54] INK AGITATOR FOR PRINTING PRESSES

[76] Inventor: Philip J. Hardin, 850 Park La., Elm Grove, Wis. 53122

[21] Appl. No.: 770,176

[22] Filed: Aug. 28, 1985

[51] Int. Cl.[4] ..... B41F 31/06

[52] U.S. Cl. ..... 101/363; 101/DIG. 8

[58] Field of Search ..... 101/DIG. 8, 364, 350, 101/363, 207–210, 366, 355, 356, 360; 366/53, 54, 55, 56, 60, 61, 64, 332, 342, 343, 345, 346, 607

[56] References Cited

U.S. PATENT DOCUMENTS

| | | | |
|---|---|---|---|
| 1,142,019 | 6/1915 | Buettner | 101/DIG. 8 |
| 1,773,819 | 8/1930 | Lindsay | 101/DIG. 8 |
| 1,896,034 | 1/1933 | Weed | 101/DIG. 8 |
| 2,849,952 | 9/1958 | Gegienheimer | 101/364 X |

FOREIGN PATENT DOCUMENTS

| | | | |
|---|---|---|---|
| 1039831 | 8/1966 | United Kingdom | 101/364 |

*Primary Examiner*—J. Reed Fisher

*Attorney, Agent, or Firm*—Fuller, House & Hohenfeldt

[57] ABSTRACT

An ink agitator element is mounted to a carriage and translated reciprocally lengthwise of a roller in the ink fountain. The carriage is driven by means of a cable connected to the piston of a pneumatic actuating cylinder. A 2-way control valve alternately pressurizes and exhausts opposite sides of the piston. Adjustable stop members set anywhere along the carriage path determine carriage travel distance in both directions by operating the valve to effect carriage reversal. Various ink agitating or stirring elements are disclosed. One such agitator element caused to swing at the end of its travel to thereby sweep ink toward the ends of the fountain roller besides urging ink into the roller nip as the agitator element translates.

16 Claims, 11 Drawing Figures

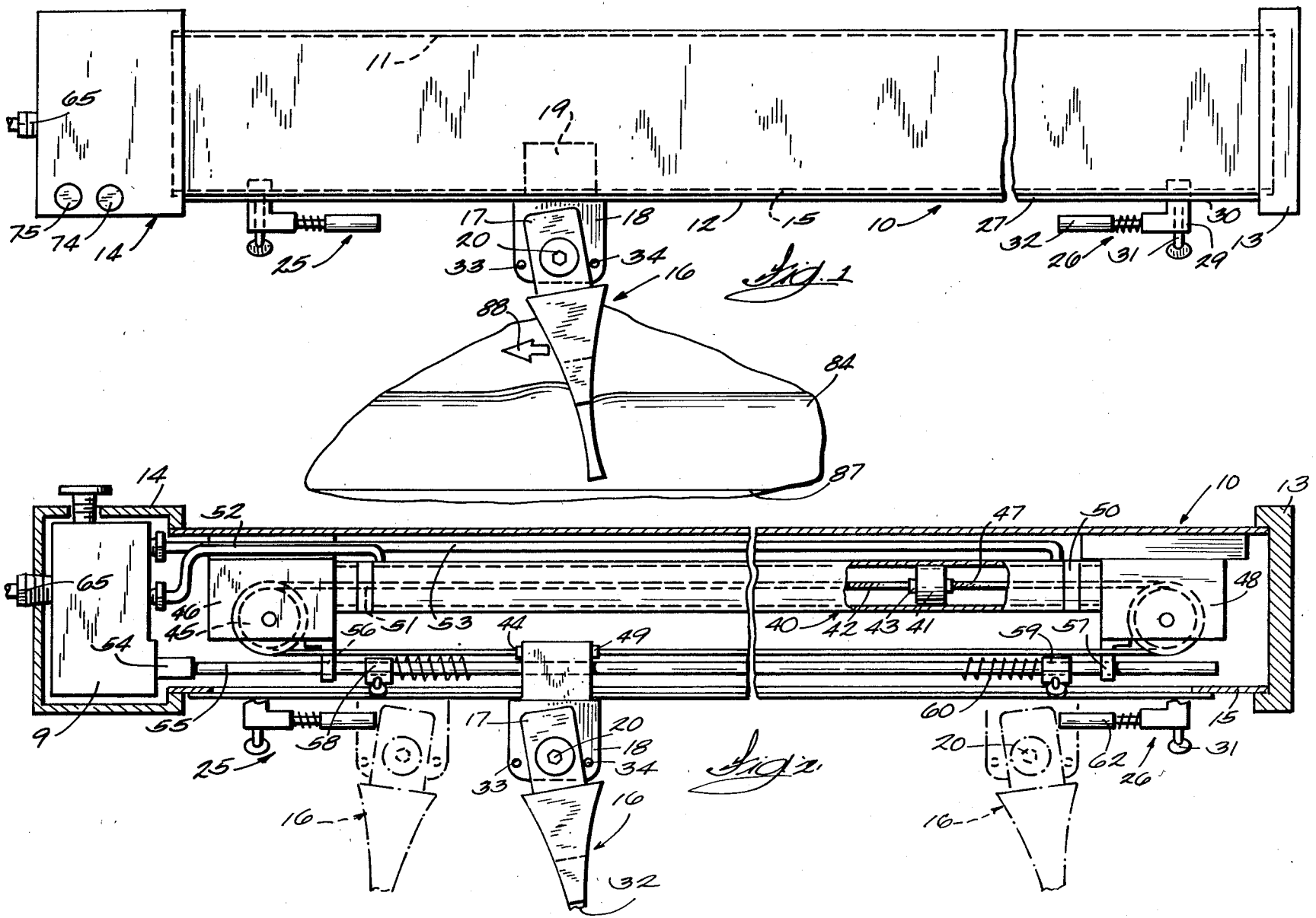

INK AGITATOR FOR PRINTING PRESSES

BACKGROUND OF THE INVENTION

This invention relates to an ink agitator for use in ink fountains of printing presses.

It is customary to provide a traversing agitator in the ink fountain to mix the ink, to prevent ink skinning, to maintain a uniform distribution of ink along the length of the fountain and, most importantly, to assure that the ink is applied uniformly along the length of the ink fountain roller and there is an adequate supply of ink at the metering nip between the roller and the ink fountain blade.

A feature common to most, if not all, ink agitator devices is a stirring element having a configuration which, when the element is translated longitudinally of the fountain, applies components of force which tend to overcome cavitation of the ink next to the rotating roller and which drive ink positively into the nip between the roller and fountain blade. Most commonly, the ink agitator stirring element is mounted on a carriage which is reciprocated with an electric motor having a gear type speed reducer which drives a closed loop chain running horizontally on sprockets. Means are provided for coupling the carriage to the upper run of the chain to drive the carriage and stirring element in one direction and to uncouple the carriage from the upper run at the desired limit of the traverse and couple it to the lower run for being driven in the opposite direction to the other limit.

Ink agitator elements of various configurations have been devised. A commonly used ink agitator uses a rotating cone shaped element which is positioned in the ink fountain with its axis transverse to the axis of the ink fountain. There is a small clearance between the periphery of the cone and the fountain blade. The apex of the cone is placed as close as possible to the line where the blade becomes nearly tangent to the fountain roller with the objective of assuring that ink will be forced into the nip between the roller and the blade. The cone is attached to a carriage which is driven by a closed loop chain reversibly along the length of the fountain. Typically, a pinion is provided on the cone axis and it engages with a stationary rack so as to impart rotational motion to the cone during its translation. A cone type agitator is described in U.S. Pat. No. 2,849,952 issued on Sept. 2, 1958 to H. W. Gegenheimer. Although the cone shaped ink agitator has been widely used, the motor, speed reducer sprocket and closed looped chain mechanism which is used to translate the ink agitator is complicated and expensive to manufacture. The motor and speed reducer all stand up prominently above the frame which supports the agitator drive mechanism which means that these components can be obstructions to movements of the pressmen when he is cleaning the inking fountain. Moreover, these prior art drive systems do not provide optimum translational speed and translational limit adjustments. The prior art drive mechanisms also use a relatively large number of moving parts which, not only increases manufacturing costs but also increase the need for lubrication and other maintainence procedures.

SUMMARY OF THE INVENTION

The present invention obsoletes the prior art chain drive systems for reciprocating an agitator element along the ink fountain of a press. In accordance with the invention, a fluid actuator comprised of a cylinder in which there is a double-acting piston is used as the prime mover for an ink agitator device. The cylinder is mounted to a support which is adapted for being attached to the press next to the ink fountain. A carriage is mounted on the support for being driven translationally along a line that is parallel to the axis of the cylinder. The piston and carriage are connected in a cable loop and guide means, such as idler pulleys, are provided to cause the cable run in which the carriage is interposed to be in parallel with the cable run in which the piston is interposed within the cylinder. Thus, in the preferred embodiment when the cylinder is driven by air pressure in one direction the carriage moves in the opposite direction at the same speed as the piston. Rotating or non-rotating agitator elements can be adapted for being driven with this carriage. A two-way, two-position valve is used to control the actions of the ink agitating or stirring element mounted thereon. The two-way valve affords great flexibility in carriage translational speed and agitator element rotational speed in those cases where a rotationally driven agitator such as the traditional conical agitator is used. Means are provided to permit easy adjustment of the longitudinal travel distance of the carriage. The traversing speed of the carriage and the limits of its travel are easily selected and adjusted without the use of tools. All that is required is for the press operator to turn thumb screws on the control valve until what appears to be optimum translational speed of the agitator is observed. Optimum speed exists when the ink is being forced against the roller and into the nip with minimum cavitation and with neither a shortage nor an excessively high wave of ink being developed at the limits of agitator translation. For the first time in an ink agitator device, in accordance with the invention, the agitator can be caused to translate at a different speed in one direction than in the other.

In addition to the new type of agitator driver being disclosed herein, an improved agitator element concept is also disclosed. Two different ways of implementing the concept are presented.

A more specific description of preferred embodiments of the invention will now be set forth in reference to the drawings.

DESCRIPTION OF THE DRAWINGS

FIG. 1 is a plan view of the new agitator apparatus associated with an ink fountain which is shown fragmentarily;

FIG. 2 is a plan view of the agitator apparatus with the cover of the housing broken away to show the structure within its interior;

FIG. 8 is a diagrammatic view of the conically shaped agitator element used in the FIG. 6 embodiment of the invention, the agitator element being disposed in an ink fountain adjacent an ink fountain roller;

DESCRIPTION OF A PREFERRED EMBODIMENT

Figures 3, 4, 5, 6, 9:
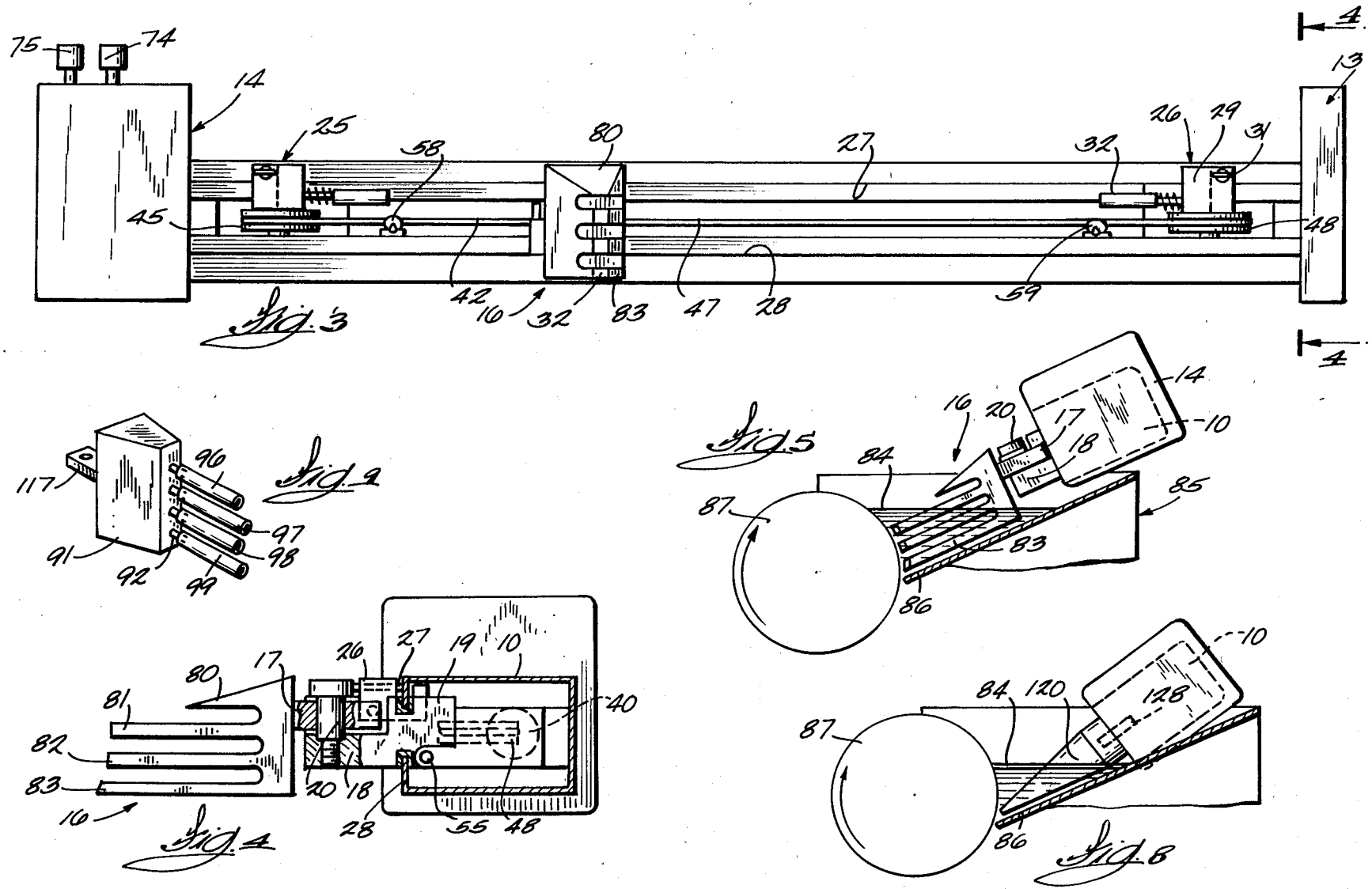
FIG. 3 is a rear elevation view of the agitator apparatus.
FIG. 4 is a vertical section taken on a line corresponding to 4—4 in FIG. 3 for illustrating a new type of agitator element and the manner in which it is mounted for swinging and translation along an ink fountain.
FIG. 5 is a side elevation view of the agitator mechanism with the agitator element disposed in an ink fountain adjacent to the ink fountain roller.
FIG. 6 is a plan view of an alternative embodiment of an ink agitator operating apparatus whose prime mover is a pneumatic actuator, as is true of the previously mentioned embodiment but where the agitator element not only translates but rotates during translation as well.
FIG. 9 is another version of a multiple finger agitator element usable with the agitator apparatus depicted in FIGS. 1 and 2.

Referring to the FIG. 1-3 embodiment of the agitator device it comprises a channel like metal housing, generally designated by the reference numeral 10. The housing is the principal support member for the mechanism that actuates the ink agitator as will be soon evident. One end of the housing is closed by a mounting block 13. The other end of housing 10 terminates in a valve casing 14. The valve is designated generally by the numeral 9 in FIG. 2. Rear wall 12 of housing 10 has an opening or slot 15 substantially coextensive with its length. A top view of one type of agitator element 16 may be seen in FIGS. 1 and 2. This new version of an agitator element will be described in greater detail later. The agitator element 16 has a tang 17 extending from it. The tang is provided for permitting the agitator element to be mounted at its proximal end to an extension 18 of a carriage 19 by means of a smooth shank machine screw 20 as can be seen most clearly in FIG. 4. By means of a mechanism, which will be described, the carriage 19 and, hence, agitator element 16 are translated reciprocally in the lengthwise or longitudinal direction of the support housing.

As can be seen in FIG. 1, a pair of striker members 25 and 26 are adjustably secured to the rear face of the support housing. As shown in FIG. 4, two longitudinally extending flanges or lips 27 and 28 define the opening through which the carriage extension 18 projects. As demonstrated in FIG. 1 a typical striker member 26 has a body 29 in which there is a groove 30 into which rear lip 27 of the housing extends. A thumb screw 31 extends through the body 29 which, when loosened, allows the body 29 to be slid along the lip 27 to any desired position of adjustment. The striker member is provided with a spring biased shock absorbing slightly yieldable plunger 32 which is aligned with the tang 17 on the agitator element 16. As demonstrated in FIG. 2, when the agitator 16 is being translated from right to left, the agitator is angulated as shown in solid lines with its distal end 32 trailing. When the carriage 19 and agitator 16 reach the limiting position at the left in FIG. 2 as shown in phantom lines, tang 17 runs into striker 25 which changes the angle of the agitator as shown. The tang can swing between angular limits set by fixed stop pins 33 and 34. A plane perpendicular to the line of movement of the carriage and which passes through the swinging axis of the agitator element bisects the angle defined by said axis and the two pins. When the carriage 19 and agitator 16 reach the right limit of travel, the tang 17 strikes striker 26 which swings the agitator to the angle in which it is shown in phantom lines at the right side of FIG. 2 where the agitator is now properly angulated for sweeping through the ink in the fountain to the left. Note that as the agitator 16 is translated through ink in the fountain the distal end of the agitator element lags or trails the proximal end.

The drive means for driving the carriage 19 reciprocally on support member 10 will now be discussed. The drive means comprises a fluid actuator including a pneumatic cylinder 40 in which there is a piston 41. The piston drives the carriage by means of a closed loop cable. One of the cable sections 42 is fastened to the piston with a fitting 43 and the other end of cable section 42 is fastened to carriage 19 by means of a fitting 44. A loop guide in the form of an idler pulley 45 is supported for rotation on a block 46 which is fixed in support housing 10. The other cable section 47 runs around a similarly mounted idler pulley 48 and connects with carriage 19 by means of a fitting 49. A stationary cylinder having a peripheral groove could supplant the idlers. The cable sections 42 and 47 in an actual embodiment are flexible metal cables within a tubular flexible plastic sheath, not shown. The cylinder 40 has end caps 50 and 51 which have a central hole through which the cable section pass. The sheath reduces air leakage below what it would be if bare stranded cable were used. Fluid actuators of the type used in the ink agitator are commercially available in an assortment of cylinder lengths.

Piston 41 is reciprocated under the control of a 2-way valve which is designated generally by the numeral 9. Valve 9 is connected to opposite ends of cylinder 40 by means of tubes 52 and 53. As seen in FIG. 2, an actuating stem 54 projects from the body of valve 9. The actuating stem is connected to a rod 55 which is almost as long as the agitator support 10. Rod 55 is supported for sliding axially in stationary brackets 56 and 57. Carriage 19 is also slidable on rod 55 between two axially adjustable stop members 58 and 59. Springs such as the one marked 60 are provided on rod 55 so carriage 19 will impact the stop members through the springs more softly. As evident in FIG. 2, when carriage 19 moves to the right and into engagement with stop member 59, valve control rod 55 will shift to the right and switch the valve 9 to cause piston 41 to drive in a direction opposite to that in which it was driven when the carriage was moving to the right. Similarly, when carriage 19 abuts stop member 58, rod 55 slides to the left and actuates the valve so that the carriage will reverse again. The stop members are provided with clamping thumb screws 62 which permit the stop members 58 and 59 to be set on rod 55 to allow for any desired amount of carriage travel.

Figures 6, 7, 10, 11:
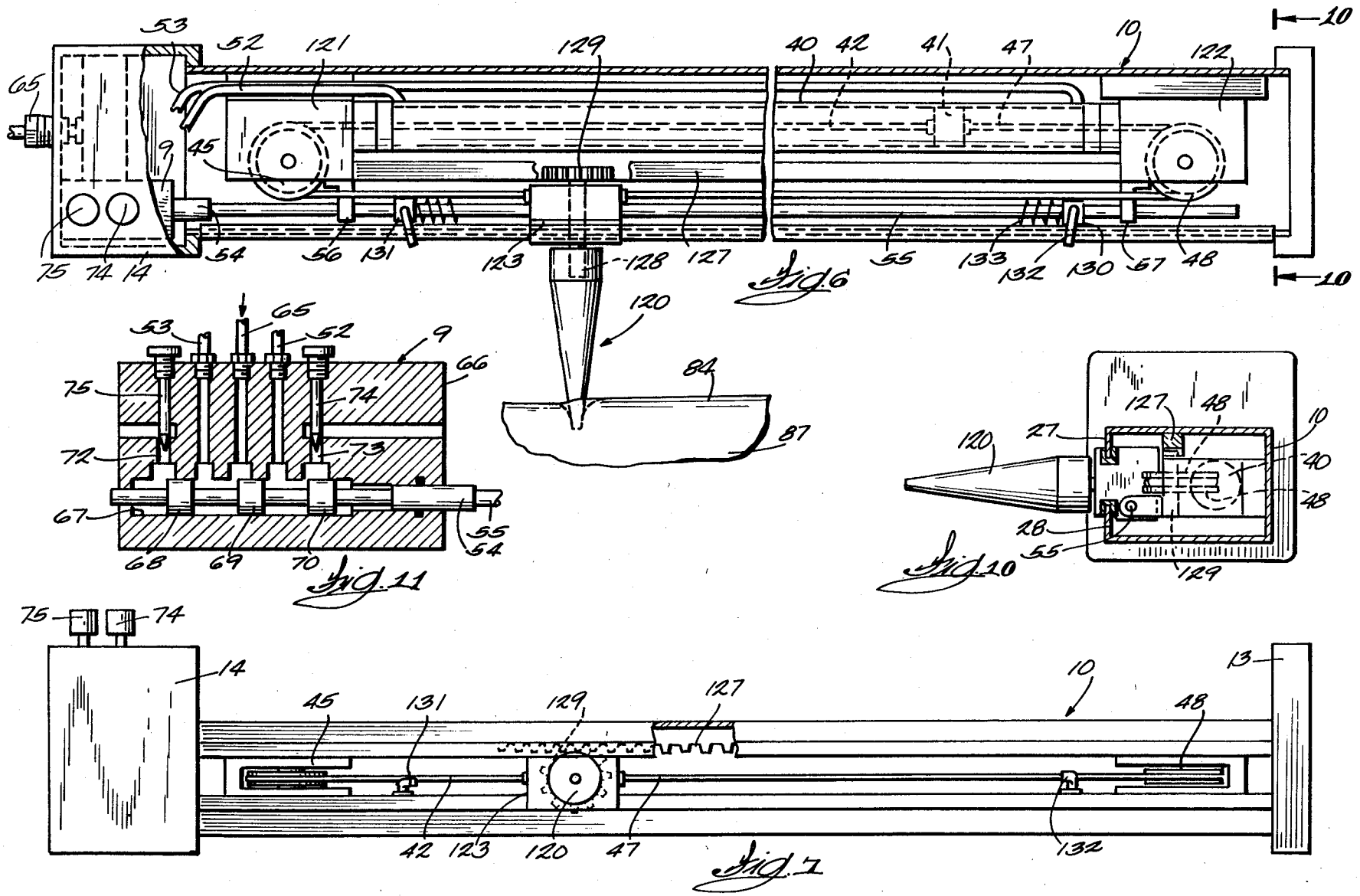
FIG. 7 is a rear elevation view of the agitator apparatus depicted in FIG. 6.
FIG. 10 is a vertical section taken on a line corresponding to 10—10 in FIG. 6.
FIG. 11 is a functional diagram of a fluid control valve that is used in the FIG. 1 and FIG. 6 embodiments of the agitator apparatus.

A functional diagram of a suitable fluid control valve 9 is shown in FIG. 10. The pressurized air input line is marked 65. Lines 52 and 53 which connect to opposite ends of actuator cylinder 40 act alternately as pressure feed lines when the piston is being driven in one direction and as exhaust lines when the piston is being driven in the other direction. The valve comprises a body 66 having a bore 67 in which there is a spool having 3 cylinders 68, 69 and 70. The actuator rod which carries valve tripping stops 58 and 59 is marked 55 in FIG. 10 as it is in FIG. 2. When the sliding spool is in the position in which it is shown in FIG. 10, line 53 becomes the pressurized supply line so that full line pressure is applied to the right side of piston 41 as viewed in FIG. 2. The pressurized air feed path is indicated by the solid air-headed line 71. There are two exhaust ports 72 and 73 in the valve body. Exhaust port 73 is modulated by a needle valve 74 and exhaust port 72 is modulated by a needle valve 75. Presently, in FIG. 10, exhaust port 72 is shut off by spool cylinder 68. Spool 70, however, is positioned so that exhaust port 73 is open. Thus, the air exhausting from the left side of the piston in FIG. 2 is transmitted through tube 52 and out of exhaust port 73. With this kind of a valve, whatever pressure is on the air feed 65 is applied to the piston and the speed at which the piston travels is governed by the exhaust rate as established by adjustment of the needle valves. In the commercial valve a small axial movement of the actuating rod causes the valve to switch feed and exhaust lines.

As explained earlier, when the piston is being driven to the left as viewed in FIG. 1 in this description of an operating cycle, the carriage 19 ultimately abuts stop member 59 which causes valve actuator rod 55 to slide to the right and thereby shifts the spool in the valve so that tube 52 becomes the pressure feed line and tube 53 becomes the return line to the exhaust port 72.

It may be observed in FIG. 2 that if the agitator 16 is moving to the left as shown in solid lines, it will be angulated so that its distal end 32 is trailing as shown. When its tang strikes striker member 25, the agitator is turned counterclockwise through a small angle. Although the ink fountain roller is not shown in FIG. 2, it will be understood to run the length of an ink fountain through which the agitator 16 is propelled bidirectionally. Ordinarily it is not possible to have the actuator carriage run to the end of the ink fountain in which case the agitator would not translate to the end of the fountain roller and it might become starved of ink. By swinging the distal end 32 or outboard extremity of the actuator in the manner just described, the ink is swept to the end of the ink fountain roller.

It should be recognized that tang 17 of the agitator element 16 strikes striker members 25 and 26 and swinging of the outboard distal end 32 of the agitator toward the end of the ink fountain and the fountain roller occurs before reverse translation of carriage 19 starts. In other words, in every operating cycle, striker members 25 and 26 which control agitator swinging are struck first and the swing is complete before the valve control stop members 58 and 59 are abutted by the agitator carriage.

Some new types of agitator elements have been invented and are disclosed herein. Agitator element 16 depicted in FIGS. 1–5 is one of them. The profile of this agitator element is visible in FIGS. 4 and 5 where it may be seen to be comprised of four blades 80–83. It is like a hand with four fingers. In this embodiment, the fingers or blades 80–83 are rigid. As shown in FIG. 5, at least three of the blades slice through ink 84 in the ink fountain 85. The lowermost blade 83 is parallel to the bottom or ink roller blade 86. The ink fountain roller in FIG. 5 is marked 87. It rotates clockwise so as it passes the edge of blade 86 it acquires a film of ink about equal in thickness to the gap between the edge of blade 86 and the periphery of fountain roller 87. The tips or distal ends of blades 80–83 are designated collectively by the numeral 32 in FIG. 3 as they are in FIG. 2. The length of the blades 81–83 are such that their tips, respectively, lie on the arc of a circle that is concentric with the fountain roller 87. The lowermost blade 83, in particular, assures that ink will be forced into the nip between the fountain roller periphery and the fountain roller blade 86. Another advantage results from having the blades or fingers of the agitator element swing to an angle other than perpendicular to the line of movement of the agitator through the ink. In FIG. 1 the line of movement is indicated by the arrow 88 which is also a vector of the forces applied by the agitator fingers to the ink 84. Because of the agitator 16 being angulated, another vector or component of force is developed on the surface of the agitator which is perpendicular to vector 88 and is directed toward the ink roller 87. This vector, consequently, forces the ink toward the fountain roller. Cavitation, which is so problematical in prior art agitators, is thereby minimized. Forcing the ink toward the roller is especially important in the vicinity of the lowermost blade 43 where a cavity is likely to result in unevenness in the ink coating on the periphery of fountain roller 87.

Another agitator element that is adapted for being swung at the end of each traverse is depicted in FIG. 9. This agitator element is comprised of a body 91 from which a tang 117 projects. Tang 117 is comparable to tang 17 in the agitator element just discussed. In FIG. 9, there are a plurality of pins 92–95 extending from body 91. The agitator fingers in this case are bendable tubes 96–99 which are held on the pins. These tubes may be made of a material such as nylon or other plastic which permits the tubes to bend a certain amount as they sweep through the ink. Bending or curvature, of course, is relatively slight but sufficient to dispose the fingers at an angle about equal to the angle in which the fingers of agitator element 16 are disposed in FIG. 1. By chosing fingers that are only sufficiently flexible to permit them to assume a limited curvature as they pass through the viscous ink, the force vector will be developed which will drive ink toward the fountain roller as was the case in the previously described embodiment of the agitator element.

The flexible fingers do not have to be circular as they are depicted in the FIG. 9 embodiment. The fingers can have a round, square, triangular or even a diamond shaped cross section. An important feature of the FIG. 9 type of agitator element is that the fingers can be pulled off of the pins extending from body 91 so they can be cleaned off of the press without any tools being needed to remove them for cleaning nor to reinstall them.

FIGS. 6 and 7 depict another embodiment which uses a fluid actuator to control an ink agitator element. This embodiment uses a conventional cone shaped agitator element marked 120. The cone is comparable to one used in the ink fountain mixer described in U.S. Pat. No. 2,849,952 which issued to Gegenheimer. In the patent and in the present disclosure, the cone element 120 is translated through the ink and simultaneously rotated in a direction opposite of translational motion. In other words, looking toward the apex of the cone, if the carriage behind it is translating to the right, the cone will be turning counterclockwise and if the carriage is translating to the left, the cone will be rotating clockwise.

In the FIGS. 6, 7, 8 and 10 embodiment, parts that are identical to the FIGS. 1–3 embodiment are given the same reference numerals. Thus, the ink agitator device is comprised of a middle support housing 10 that terminates in a mounting block 13 at one end and in a valve housing 14 at the other end. The valve 9 enclosed in the housing is the same as that used in the preceding embodiment and it again has the functional characteristics of the hypothetical valve diagrammed in FIG. 11. There are two brackets, 121 and 122 mounted to the interior of housing 10 in FIG. 6. These brackets support idler pulleys 45 and 48. A fluid actuator cylinder 40 is supported inside of housing 10 as in the previous embodiment and the cylinder contains a piston 41 connected to cable sections 42 and 47 which loop around the idler pulleys 45 and 48 and connect to a carriage 123. As can be seen in FIG. 10, the carriage is guided along its translational path by running it on lips 27 and 28 which are formed with metal housing 10 and serve as tracks. Brackets 56 and 57 extending from blocks 121 and 122 support a longitudinally extending rod 55 which is slidable to a limited degree in its mounting brackets. Carriage 123 is further guided and supported for linear movement by rod 55. Rod 55 is connected to the actuating stem 54 of valve 9 as in the preceding embodiment.

In the FIG. 6 embodiment, the agitator 120 is supported on a shaft 128 that is journaled in carriage 123 and has a pinion 129 fastened to it. A gear rack 127 is fastened within the housing above pinion 129. Translation of carriage 123 under the influence of the fluid actuator causes pinion 129 driven rotationally in a direction opposite of the direction in which the carriage is being translated. The apex or tip of cone 120 thus stirs through the ink 84 while the side of the cone is rather close to and parallel to the bottom or blade 86 of the ink fountain as can be seen in FIG. 8. The apex of the cone is positioned in the traditional manner, that is, the apex is close to the nip between ink fountain roller 87 and the fountain blade 86. The objective, of course, is to urge the ink into the fountain to coat the ink fountain roller 87 uniformly.

Slide rod 55 has a pair of stop elements 130 and 131 clamped onto it by means of screw handles 132, for example. When screw handles 132 are tightened, stop 130 is immovable on rod 55. In other words, the stops are adjustable along the rod and are used to establish the distance through which the agitator element carriage shall be allowed to translate. A bumper spring 133 is fitted over rod 55 between stops 130 and the carriage. When the carriage, as the carriage translates into one stop 130 or the other 131, it causes rod 55 to move a short distance and actuate the valve operator stem 54. As in the previous case, each time the valve is actuated or switched, it causes one side of piston 41 to exhaust and the other side to have full line pressure applied to it so the carriage reverses its direction. The ink agitator device in the FIGS. 6 and 7 embodiment has the same desirable property as in the previous embodiment. That is, the translational distance through which the cone agitator element 120 travels is selectable by setting stop elements 130 and 131 at the desired place along the valve actuator rod 55. In addition, the rate at which the carriage translates is controllable by adjusting needle valves 74 and 75 which control the rate at which air is exhausted from one side of piston 41. As in the previous embodiment, it is possible to adjust the needle valves 74 and 75 such that the carriage and agitator element 120 will translate faster in one direction than in the other.

Although embodiments of the invention have been described in detail, such description is intended to be illustrative rather than limiting, for the invention may be variously embodied and is to be limited only by interpretation of the claims which follow.

I claim:

1. An ink agitator device for use with a printing press having an elongated ink fountain including an ink fountain blade with a substantially flat upper surface and said fountain having a longitudinally extending ink fountain roller therein, said agitator device comprising:

elongated support means for being mounted adjacent said ink fountain roller, a fluid actuator including a longitudinally extending cylinder mounted to said support means and a piston in said cylinder, a carriage mounted to said support means for translating longitudinally in opposite directions along a path parallel to said cylinder, a cable loop attached inside of the cylinder to said piston and outside of the cylinder to said carriage and guide means outside of said cylinder arranged to guide said cable such that when said piston translates in said cylinder under the influence of pressurized fluid said carriage translates generally parallel to said cylinder, an agitator element mounted to said carriage and extending into said ink fountain for translating through ink in said fountain to urge said ink toward said ink roller, control valve means including a body having an inlet for pressurized fluid and having ports in communication with said cylinder, respectively, at opposite sides of said piston, said valve having an operator which when in a first position causes pressurized fluid to be applied to one side of said piston and relief of pressure from the other side and when in a second position causes pressurized fluid to be applied to said other side and relief of pressure from said one side so as to drive said piston, said carriage and said agitator element cyclically in alternate longitudinal directions, and longitudinally spaced apart stop elements between which said carriage translates, said stop elements being operatively coupled to said valve operator and responding to approach of said carriage while traveling in one direction by operating said operator to cause said carriage to travel in the opposite direction.

2. The ink agitator device according to claim 1 including means in said control valve for setting the rate at which fluid pressure is relieved from the side of the piston opposite the side to which pressurized fluid is applied.

3. The ink agitator device according to claim 1 including means in said control valve for setting the rate at which fluid pressure is relieved from one side of the piston when pressure is applied to the other side and separate means for setting the rate at which fluid pressure is relieved from said one side when fluid pressure is applied to said other side such that said carriage can be controlled to translate at a speed different in one direction than in the other.

4. The ink agitator device according to claim 1 wherein said agitator element is mounted to said carriage for swinging about an axis through angles on opposite sides of a plane that is perpendicular to the line along which said carriage translates and that passes through said axis, a striker member set proximate to each desired limit of carriage translation, said carriage and said agitator element thereon translating between said striker members, said agitator element being angulated to one side of said plane when said element is translating through positions intermediate of said striker members, and said agitator element responding to striking a striker member while translating in one direction by angulating to the other side of said plane in preparation for being translated in the opposite direction.

5. The ink agitator device according to claim 4 wherein said striker members are set near opposite ends of said fountain roller such that when said agitator element strikes a striker member the element will swing in a direction to push ink toward the end of said fountain roller.

6. The agitator device according to claim 1 wherein said agitator element comprises an agitator body mounted to said carriage for swinging between angular limits about an axis perpendicular to the plane along which said carriage translates, a plurality of spaced apart fingers extending from said body generally toward said fountain roller for passing through ink and urging ink toward said fountain roller as a result of said agitator element being translated, said fingers terminating in free ends remote from said body and said fingers varying in length such that their free ends terminate generally along the arc of a circle which is generally concentric to the ink roller, a striker member set proximate to each desired limit of carriage translation, said carriage and said agitator element thereon translating between said striker members with said fingers angulated to one of said angular limits oppositely of the direction in which said carriage is translating so the ends of said fingers trail the positions of said axis, abutment of said agitator element against one striker member causing said agitator element to swing and to angulate said fingers to the other of said angular limits before said control valve is actuated to cause said carriage to translate toward the other striker member.

7. The ink agitator device according to claim 6 wherein said fingers of the agitator element are flexible so as to curve backwardly of the direction of translation as they pass through ink in the fountain.

8. The ink agitator device according to any one of claims 6 or 7 including means for releasably attaching said fingers to said body.

9. The ink agitator device according to claim 1 wherein said agitator element is comprised of a body and a plurality of fingers extending from said body toward said ink fountain rollers.

10. The ink agitator device according to claim 9 wherein said fingers of the agitator element are flexible so as to curve backwardly of the direction of translation as they pass through ink in the fountain.

11. The ink agitator device according to claim 1 including:

a shaft mounted for rotation on said carriage, said agitator element comprising a cone shaped member adapted for being mounted to the shaft with the axis of the member substantially coaxial with the axis of the shaft, said cone shaped member being constructed and arranged for its axis to project toward said fountain roller and the apex of the cone to be in proximity with the nip between said roller and said ink fountain blade, a gear rack fixed on said elongated support means and extending along the translational path of said carriage, and gear means connected to said shaft and meshed with said gear rack for compelling said shaft and cone shaped member to rotate as a result of said carriage being translated.

12. The ink agitator device according to claim 11 including means in said control valve for setting the rate at which said fluid pressure is relieved from one side of said piston when pressure is applied to the other side and separate means for setting the rate at which pressure is relieved from said one side when fluid pressure is applied to said other side such that the carriage can be controlled to translate at a speed different in one direction than in the other.

13. An ink agitator device for use with a printing press having an elongated ink fountain including an ink fountain blade with a substantially flat upper surface and said fountain having a longitudinally extending ink fountain roller therein, said agitator device comprising:

an elongated support member for being mounted adjacent said ink fountain roller, a fluid actuator including a longitudinally extending cylinder and a piston in said cylinder, a carriage mounted to said support member for translating bi-directionally in a path parallel to said cylinder, an idler pulley mounted at each end of said cylinder, a cable loop to which said piston is connected inside of said cylinder and to which said carriage is connected outside of said cylinder, the cable running on said idler pulleys and said pulleys being arranged to maintain the part of the cable connected to said carriage in parallelism with the part of the cable extending coaxially through said cylinder, an agitator element comprised of a tang and an integral head, said element being mounted for swinging on said carriage with said tang extending to one side of the swinging axis and the head extending to the other side and toward said ink fountain roller, said element being swingable through limited angles in both translational directions, a striker member set proximate to each desired limit of carriage translation, said carriage and said actuator element thereon translating between said striker members, abutting of said tang of said agitator by striker members at each limit of translation causing said agitator element to swing on said carriage to opposite angular limits, control valve means for said actuator including a body having an inlet for pressurized fluid and having ports in communication with said cylinder, respectively, at opposite sides of said piston, said valve having an operator which when in a first position causes pressurized fluid to be applied to one side of said piston and relief of pressure from the other side and when in a second position causes pressurized fluid to be applied to the other side of said piston and relief of pressure from said one side so as to drive said piston said carriage and said agitator element cyclically in opposite longitudinal directions, stop elements settable to determine the limits of carriage translation in each direction, said stop elements being operatively connected to said valve operator and responding to the approach of said carrriage while translating in one direction by operating said operator to cause said carriage to translate in the opposite direction.

14. The ink agitator device according to claim 13 including means in said control valve for setting the rate at which fluid pressure is relieved from one side of said piston when pressure is applied to the other side, and separate means for setting the rate at which pressure is relieved from said one side when fluid pressure is applied to said other side such that the carriage can be controlled to translate at different speeds in each direction.

15. An ink agitator device for use with a printing press having an elongated ink fountain including an ink fountain blade with a substantially flat upper surface and said fountain having a longitudinally extending ink fountain roller therein, said agitator device comprising:

an elongated support member for being mounted adjacent said ink fountain roller, a fluid actuator including a longitudinally extending cylinder and a piston in said cylinder, a carriage mounted to said support member for translating bi-directionally in a path parallel to said cylinder, an idler pulley mounted at each end of said cylinder, a cable loop to which said piston is connected inside of said cylinder and to which said carriage is connected outside of said cylinder, the cable running on said idler pulleys and said pulleys being arranged to maintain the part of the cable connected to said carriage in parallelism with the part of the cable extending coaxially through said cylinder, a shaft mounted for rotation on the carriage and a gear on one end of the shaft, an agitator element comprised of a cone shaped member mounted substantially coaxially to the other end of said shaft, said member being constructed and arranged for its axis to project toward said ink fountain roller and the apex of the cone to be in proximity with the nip between said roller and said ink fountain blade, a gear rack fixed on said elongated support means and extending along the translational path of said carriage, said gear on said shaft being meshed with said rack such as to cause rotation of said agitator element as a result of said carriage being translated, control valve means for said actuator including a body having an inlet for pressurized fluid and having ports in communication with said cylinder, respectively, on opposite sides of said piston, said valve having an operator which when in a first position causes pressurized fluid to be applied to one side of said piston and relief of pressure from the other side and which when in a second position causes pressurized fluid to be applied to the other side of the piston and relief of pressure from said one side so as to drive said piston said carriage and agitator element cyclically in opposite directions, stop elements settable to determine the limits of carriage translation in each direction, said stop elements being operatively coupled to said valve operator and responding to the approach of said carriage while translating in one direction by operating said operator to cause said carriage to translate in the opposite direction.

16. The ink agitator device according to claim 15 including means in said control valve for setting the rate at which fluid pressure is relieved from one side of the piston when pressure is applied to the other side of the piston, and separate means for setting the rate at which pressure is relieved from said one side when fluid pressure is applied to said other side such that the carriage can be controlled to translate at different speeds in each direction.

* * * * *